US005327957A

United States Patent [19]

Killebrew

[11] Patent Number: 5,327,957

[45] Date of Patent: Jul. 12, 1994

[54] INTEGRAL HEAT EXCHANGER

[75] Inventor: Joseph B. Killebrew, Byrnes Mill, Mo.

[73] Assignee: Enfab, Inc., House Springs, Mo.

[21] Appl. No.: 72,166

[22] Filed: Jun. 3, 1993

Related U.S. Application Data

[63] Continuation-in-part of Ser. No. 926,944, Aug. 10, 1992, Pat. No. 5,217,066.

[51] Int. Cl.[5] ..... F28E 9/22

[52] U.S. Cl. ..... 165/161; 165/159

[58] Field of Search ..... 165/159, 160, 161, 162

[56] References Cited

U.S. PATENT DOCUMENTS

| | | | |
|---|---|---|---|
| 1,601,874 | 10/1926 | Muhleisen | 165/161 |
| 2,384,714 | 9/1945 | Villiger | 165/161 |
| 2,581,121 | 1/1952 | McCurdy, Jr. et al. | 165/162 X |
| 2,677,394 | 5/1954 | Brinen et al. | 165/109.1 X |
| 2,693,942 | 11/1954 | Guala | 165/161 |
| 3,240,267 | 3/1966 | Edberg | 165/159 |
| 4,029,145 | 6/1977 | Pfouts et al. | 165/161 |

FOREIGN PATENT DOCUMENTS

| | | | |
|---|---|---|---|
| 2726317 | 1/1978 | Fed. Rep. of Germany | 165/161 |
| 2744263 | 4/1979 | Fed. Rep. of Germany | 165/161 |

*Primary Examiner*—Allen J. Flanigan
*Attorney, Agent, or Firm*—Paul M. Denk

[57] ABSTRACT

A heat exchanger has a shell baffles, tube supporting means and tubes, in addition to end caps for the shell once formed, to furnish an intergral heat exchanger. The sheet for forming the tubular sheet and baffles are formed from a singular sheet of material. The tube supporting means includes he baffles which have a plurality of openings formed therein receive the tubes. The sheet is laser or die cut to form the integral baffles and rails, for insertion into the outer tubular shell, and in a further embodiment, with its closure end caps, forming the complete heat exchanger. The baffles are formed from a central panel of the sheet material, which provides arcuate openings through the central panel arranged at a median longitudinally of the tubular shell forming the heat exchanger, and thereby directs the flow of fluids to be heated centrally through the heat exchanger and in a direction where the greatest concentration of heat exchanger tubes is located, for providing maximum efficiency in heating of a further fluid passing through the heat exchanger during its operation.

3 Claims, 4 Drawing Sheets

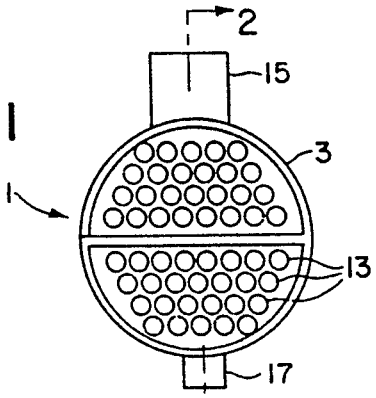
FIG. 1
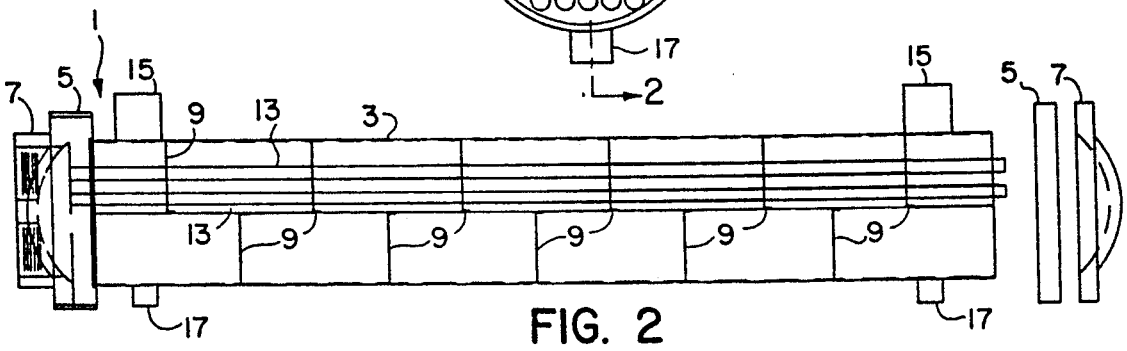
FIG. 2
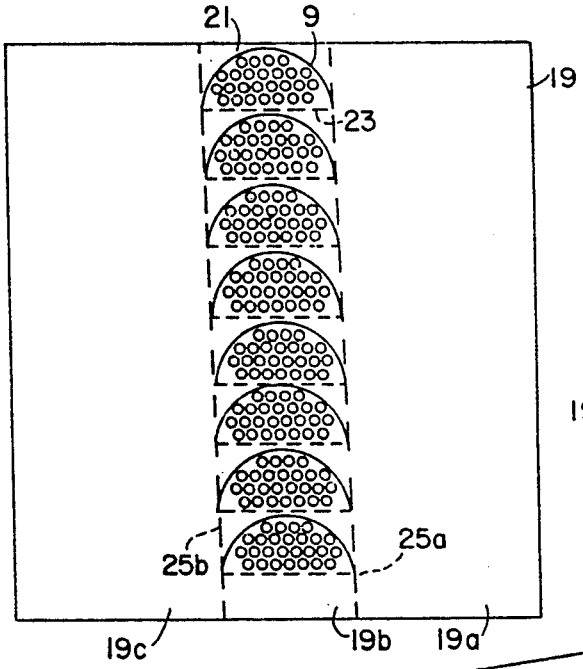
FIG. 3
FIG. 4
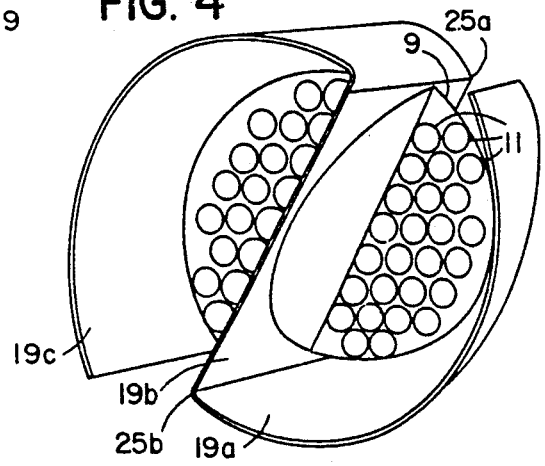
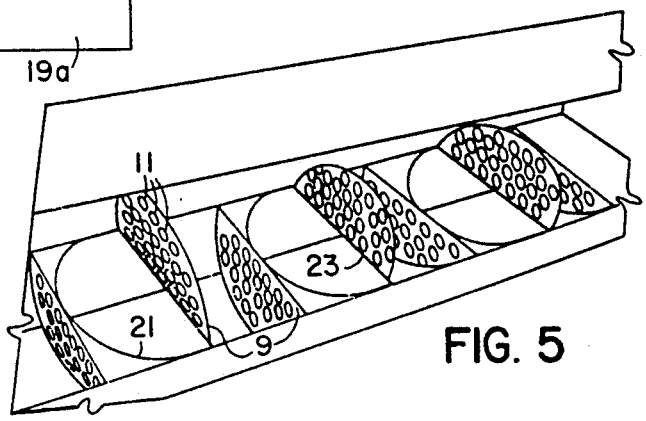
FIG. 5

INTEGRAL HEAT EXCHANGER

Cross-Reference To Related Application

This application is a continuation-in-part of the application on the invention of the same inventor having Ser. No. 07/926,944, filed on Aug. 10, 1992, and now U.S. Pat. No. 5,217,066.

BACKGROUND OF THE INVENTION

Heat exchangers are used in various industries to heat or cool various types of liquids and gases.

Most small heat exchangers are designed using a pipe or tube shell with individually fabricated baffles, tie rods, tube sheets and tubes; turbulators are sometimes used inside of the tubes to improve heat transfer.

A shell and tube heat exchanger is comprised of two sections, each of which conveys a separate fluid placed in the particular section that offers the most advantageous heat transfer for that fluid. Of these sections; one is known as the shell side and the second is known as the tube side. The two sections must accommodate conditions such as access for servicing, different pressures and may require different materials of construction in order to comply with corrosion and strength requirements.

This invention relates to heat exchangers, and in particular, to a heat exchanger having baffles and tube supports which are integral with its shell.

In order to clarify the difference between baffles and turbulators; baffles are used outside of the tubes in a manner to create turbulence and improve heat transfer by controlled flow. Turbulators or deflectors, are generally used inside of tubes to break up laminar flow.

The construction of heat exchangers thus requires securing many parts together. In a small heat exchanger, this can be difficult because of the small diameter that is being worked on. Further, the construction of the heat exchanger requires the stocking of numerous parts.

U.S. Pat. Nos. 2,677,394 to Brinen, et al., and No. 2,688,986, to O'Biren disclose turbulators formed from a sheet for use in the tubes of a heat exchanger. However, I do not know of anyone who has designed heat exchanger wherein the shell, baffles, and the tube sheets are integrally formed.

More specifically with respect to the prior art patents known to applicant, the patent to Muffly, No. 1,709,865, discloses the process of forming refrigerator elements, and the pertinency of this particular patent is to show that various components for equipment, such as the refrigeration plates, can be formed from shaped metal that is stamped and adhere together, as to be noted in FIGS. 2 and 3 of the particular device.

The patent to Lambert, No. 1,996,622, merely shows extended surface method of attachment of components of a metal radiator together. This discloses a sheet form of metal radiator. This device, once again, as can be seen, appears to be formed from a plurality of sheets of material, wherein a series of vertically disposed fins are attached to the halves of the sheet metal radiator, in order to provide the heat exchange fins, for the heating system as disclosed.

The patent to Brinen, as referred to above, No. 2,677,394, shows turbulators for installation inside of tubes. In this particular patent, as can be seen, there is contained internal structure of a spine section of a heat exchanger, which incorporates a series of sections or lobes, which are struck out, partially as to be seen, from the spine component which then integrally has a pair of lateral flanges to provide for their connection interiorly of the tube. This particular patent does not show how the entire tube section can be integrally formed from the spine component itself, after the spine has had its various lobes stamped and bent into their disclosed configuration.

Also, the patent to O'Brien, as previously referred to, No. 2,688,986, once again shows turbulators inside of tubes. This discloses a similar type of what is identified as a turbulence member, which has a variety of tongues stamped from it, and bent perpendicularly, to form the baffling configuration for the heat exchanger, as when the turbulence member is inserted within its respective tube, as can be noted.

The patent to Guala, No. 2,693,942, shows a respectable baffle design. However, this particular design is formed from multiple pieces. It discloses a further heat transfer apparatus. In this particular embodiment, the baffles appear to be formed from a single circular sheet, and then cut, stamped, and bent, into their perpendicularity, before their insertion within their respective enclosing shell of a heat exchanger. As is well known, the baffles, with their arranged openings are designed for holding the tubes of the heat exchanger.

The patent to Man Suk Lee, No. 3,400,758, shows another formed from multiple pieces. It discloses another form of helical baffle means in a tubular heat exchanger. As can be seen, this particular device shows the method for forming baffles, having a variety of bends or other shaped configurations, particularly as can be seen in the patent drawings, with these baffles then being secured into position within the heat exchanger's shell, as can be noted.

The patent to Friedman, No. 3,739,443, discloses how to construct together a shell with tight fitting baffles. This particular configuration for a heat exchanger has been around for approximately forty years. This patent discloses a method of forming a shell and tube heat exchanger. This particular patent shows a series of bundles of tubes, as can be noted in its disclosure, having supporting sheets at either end, and then the half shells are folded therearound, and clamped into position by means of the clamping strips.

The patent to Parker, No. 3,769,959, is an enlarged version of what previously was shown in the Brinen, O'Brien, and Neveux patents, for constructing turbulence inside of a tube. The tube in this particular instance may be larger and is odd shaped, but it is not integrally formed. The patent further discloses a type of heating tube and baffle arrangement for deep fat fryers. As can be noted, the baffling arrangement includes the baffle means with an outer tube arranged therearound. But it does not appear that this particular structure integrally.

The patent to Neveux, No. 4,106,558, shows another turbulator, in this particular instance, it is identified as a deflector for use inside of tubes. The patent discloses another form of a deflector for a heat exchanger tube. But, once again, while the deflectors may be formed as a series of stampings, as can be seen in its drawings, once these deflectors are fabricated, they are then split into their separate tubes for locating within a heat exchanger. It appears that the shaped cylindrical sections are independently formed, before any baffle is arranged therein.

The patent to Melnyk, et al, No. 4,546,825, describes a conventional heater, differing in that the shell of this heater is corrugated and the baffles are held in place by the recess in the corrugations. The patent specifically discloses a heat exchanger and method of assembly thereof. This particular embodiment appears to be very similar to the configuration of the previously described Freidman heat exchanger, wherein the baffles are formed independently, to support their tube bundle, but that the outer shell is formed of a pair of half angular shells.

The patent to Duncan, No. 4,727,907, discloses another form of a turbulator, with integral flow deflector tabs, which are configured as a stamping, apparently for locating within the heat exchanger pipe.

The patent to Yeh, No. 4,832,114, describes a scraped heat exchanger, and shows a device for producing high heat transfer in the heat exchanger tubes, with the internal baffling arrangement, as to be seen, being independently formed, and then apparently supported for rotation therein, by means of bearing mounts. There may even be sweeping elements provided upon the periphery of the shown strip.

These prior patents show and describe the use of a turbulator for application inside of a heat exchanger tube, especially small tubes. These types of devices were designed for use as oil coolers for diesel engines, and the like, even though they may have other applications. Other designs in the prior art as disclosed above attempt to minimize leaks between the baffles and the shell within the heat exchanger, or they are other variations upon the tube type turbulators. None of the designs in the prior art disclose a shell and baffle assembly, fabricated from a single metal plate material, into an integral type of unit.

SUMMARY OF THE INVENTION

One object of this invention is to provide a heat exchanger wherein the shell and baffles are integrally formed.

Another object is to provide such a heat exchanger wherein the tube sheets are integrally formed with the shell.

Another object is to provide such a heat exchanger which is simple and economical to produce.

A further object of this invention is to provide a means for laser cutting of an integral sheet of material into its particular components, and then folding the various components into their final shape for fabrication of the integral heat exchanger of this invention.

Another object is to provide such a heat exchanger which can be made to various desired sizes.

A further object of this invention is to improve the efficiency of baffling within a heat exchanger.

Yet another object of this invention is to provide an integrally formed heat exchanger, and its various baffles disposed therein, generally for use for holding the tube bundle in place, but due to the uniqueness of its formation, wherein the baffles are integrally stamped from their supporting central panel, and have semicircular configuration, it tends to direct the greatest flow of fluid across the greatest concentration of tubes in the tube bundle, as disposed within the heat exchanger.

These and other objects will become apparent to those skilled in the art in view of the following disclosure and accompanying drawings.

In accordance with the invention, generally stated, a heat exchanger has a shell, baffles, tube supporting means, and tubes, all integrally formed. The shell and baffles are formed from a single sheet of material, which may be stamped for mass production, or may be precision cut by the laser cutter. The tube supporting means includes the baffles, which have a plurality of openings formed therein to receive the tubes. A method of producing the heat exchanger is also disclosed. The design of this current invention also offers sufficient advantages over what had been previously done, which allows the applicant to offer different categories of metal which may be stamped or laser cut, when constructed into the formation of the exchanger itself, generally in combinations that heretofore have never been attempted, in any type of prior art heat exchanger.

Furthermore, the entire heat exchanger, including its end caps, may be integrally formed from the same sheet forming the shell or tube and baffles themselves. In addition, because the baffles are formed integrally from the center wall or panel forming support for the integral baffles, and generally since the baffles will have a configuration in the shape of a semicircular design, due to the arcuateness of the cut-out section, this positions the opening in the longitudinal section of the baffle assembly to force the flow of fluids through the shell side of the heat exchanger and be directed into the position where the greatest concentration of tubes are located, in order to enhance and increase the efficiency of operations of this device. Thus, the fluid is forced to flow centrally in the shell, rather than along its side edges, and thereby becomes exposed to a maximum number of tubes. These are examples of the advantages to be attained from the integral heat exchanger and its method of construction as defined and explained in this application.

DESCRIPTION OF THE DRAWINGS

FIG. 1 is an end view of a heat exchanger of the present invention;

FIG. 2 is a cross-sectional view of a conventional heat exchanger tube, with the tube sheet of this invention which integrally forms the internal baffling, or flow directors, in addition to the outer shell, disclosed therein, with an exploded view of the end cap, on one end, being removed;

FIG. 3 is a plan view showing a piece of metal sheet from which the heat exchanger of this invention may be formed:

FIGS. 4 and 5 are perspective views showing the formation of the heat exchanger of this invention;

DESCRIPTION OF THE PREFERRED EMBODIMENT

Figure 6:
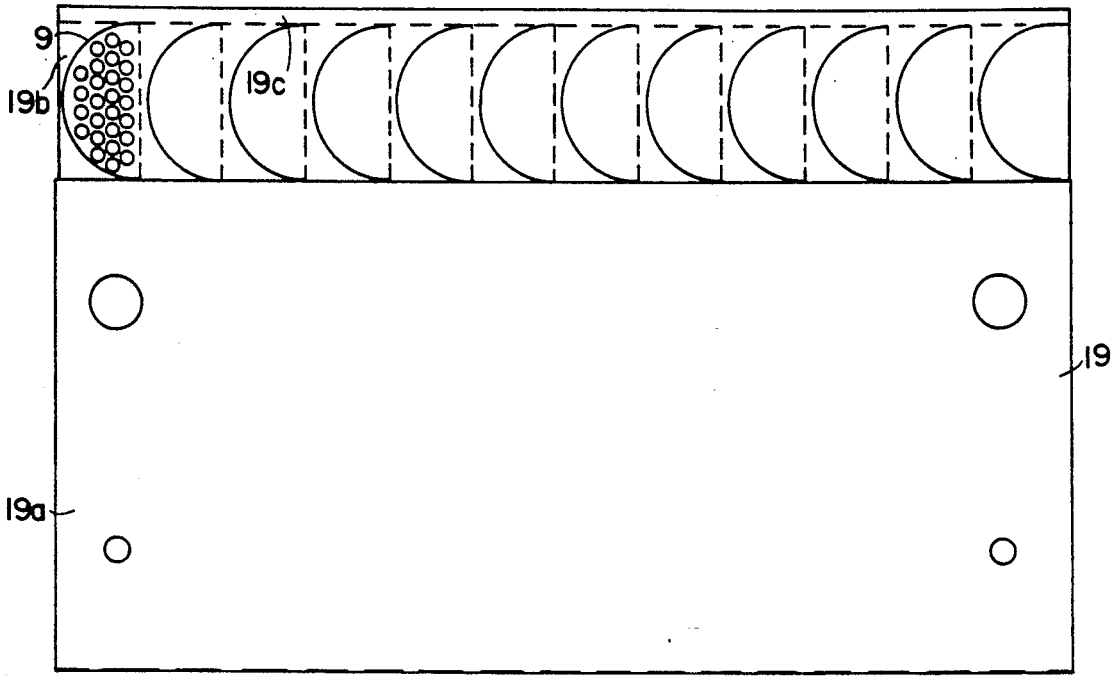
FIGS. 6 and 7 show an alternative method for cutting baffles in the sheet material, as arranged along one side edge thereof, with the remaining portion of the sheets capable of being wrapped around the formed baffles for formation of the outer shell of the heat exchanger.

Referring to FIGS. 1 and 2, a heat exchanger of the present invention is generally referred to by reference numeral 1. Heat exchanger 1 includes a tubular shell 3 having tube sheets 5 on either end. A bonnet 7 is placed over both tube sheets or end caps 5 to close heat exchanger 1. A plurality of baffles 9 extend perpendicularly from the center of heat exchanger 1 and contain a plurality of holes 11 which receive tubes 13. Thus baffles 9 support tubes 13. Baffles 9 thus act as tube supports. Baffles 9 may be semi-circular in shape and extend to the inner surface or center panel of shell 3. Baffles 9 are spaced, thus the fluid which flows through shell 3 and around tubes 13 follows a generally "S" shaped or undulated course. Tubes 13 extend through tube sheets 5 which seal the space within bonnets 7 from the space within shell 3. Nozzles or inlets 15 are formed to provide an entrance and exit into shell 3 and outside of tubes 13. Connectors or outlets 17 are provided as drains or vents for shell 3. Connections 18 are provided in bonnet 7 for entrance and exit for fluids flowing inside of tubes 13. There may be a slight spacing between the periphery of the baffles 9 and the interior of the shell 3.

Turning to FIGS. 3–5, it can be seen that shell 3 and baffles 9 are formed from a single sheet 19 of material, such as stainless steel, aluminum, or whatever other material may be needed. Sheet 19 can be described as having three initial sections, a right section 19*a*, a middle section or center panel or wall 19*b*, and a left section 19*c*. As seen in FIG. 2, baffles 9 are integrally formed in section 19*b* by cutting along a line 21, leaving a fold line 23. The baffles are then folded along line 23 to be generally perpendicular to sheet 19. Preferably, the baffles 9 are alternately bent upwardly and downwardly, as can be seen in FIG. 5, or generally bent alternately to either side. Prior to the folding of baffles 9, holes 11 are formed in baffles 9. After baffles 9 are bent outwardly, sections 19*a* and 19*c* of sheet 19 are wrapped around the baffles and welded along lines 25*a* and 25*b* to form a fluid tight tube, forming shell 3. As previously explained, since there may be a slight gap between the outer perimeter or periphery of each of the baffles 9, and the interior of the shell 3, when the welding takes place of the outer tube about the baffles, along those edges 25*a* and 25*b*, the weld shrinks along 25*a* and 25*b* and pulls the shell firmly against the outer edge of the baffles, forming a much tighter seal than can be accomplished by machining the baffles for clearance during insertion into a preformed shell.

Figure 7:
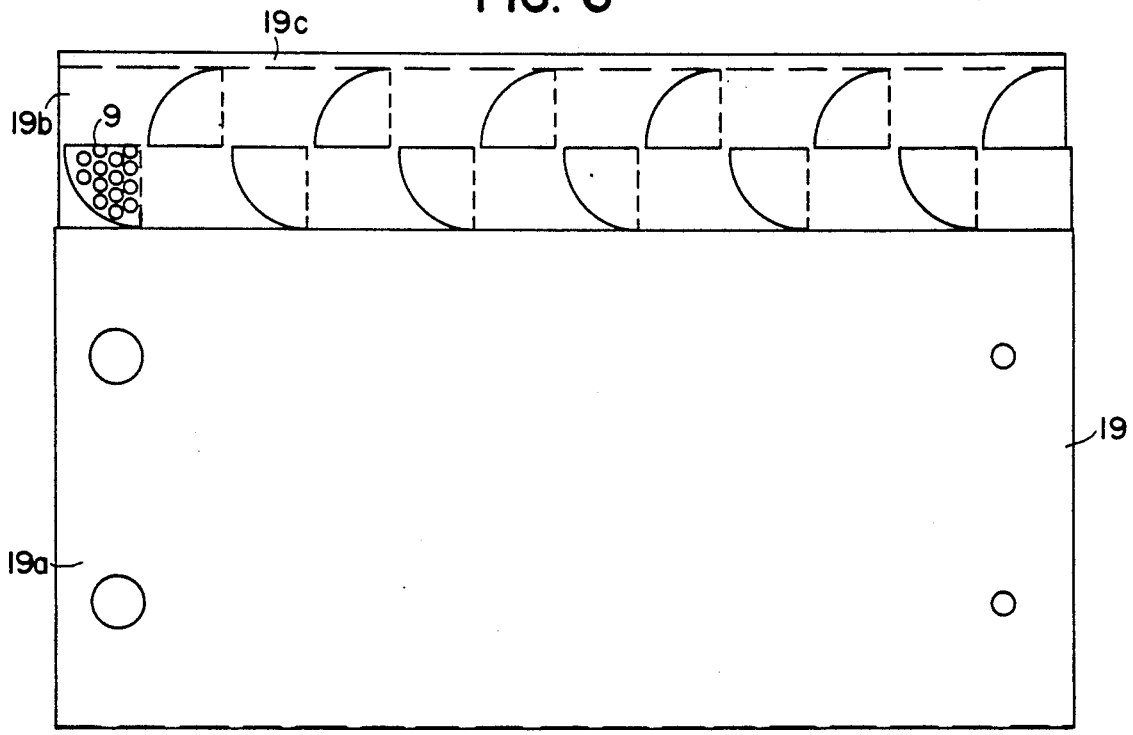
Figure 8:
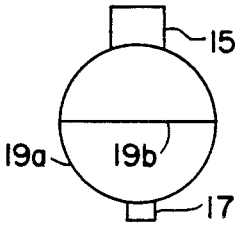
FIG. 8 shows the formation of the heat exchanger from the type of sheet as disclosed in FIGS. 6 and 7.

Turning to FIGS. 6–8, a second method of forming the heat exchanger is shown. In the method shown here, the baffles 9 with holes 11 are formed in section 19*b* of sheet 19. Sections 19*a* and 19*c*, which form the single section, are then wrapped around baffles 9 after they are folded out. As can be seen in FIG. 8, this method has the advantage of requiring only one weld along one side of the shell to form the weld line to seal shell 3.

As can be appreciated, this method allows for simple construction of heat exchangers having baffles. This is especially true for small heat exchangers in which it is difficult to secure baffles. However, this method also can be used for larger heat exchangers.

One of the features of the overall method of forming an integral heat exchanger of the type as described in this application is the usage of the laser cutting means for design and pattern cutting of the sheet material, such as the sheet 19, into the precise configuration of the various components that are to be bent and shaped into the configuration, such as shown in FIGS. 4 and 5, having their outer shell sections, such as 19*a* and 19*c* bent into the configuration of an outer casing for covering the heat exchanger into its final assembly. This can all be achieved through design cutting applied by application of the laser cutter, and once the baffles, with their appertures 11 provided therein, and the outer shells are wrapped about the configured baffles, the various tubes, such as 13, can be applied therein, to form the overall heat exchanger configuration. Or, the tubes may be applied before the outer sheet 19 is wrapped about their baffles, but after the baffles have been bent, the tubes inserted therein, and then the sheet sections 19*a* and 19*c* may be bent to provide an outer casing for the configured heat exchanger.

On the other hand, as previously explained, and particularly where mass production of smaller heat exchangers is required, a press may be configured to provide for stamping of the basic configuration of the sheet material into the formation of the integral baffles, central panel, and shell panel(s), through a singular stamping operation, in order to provide for quick and efficient manufacture of the heat exchangers of this particular design.

Figure 9:
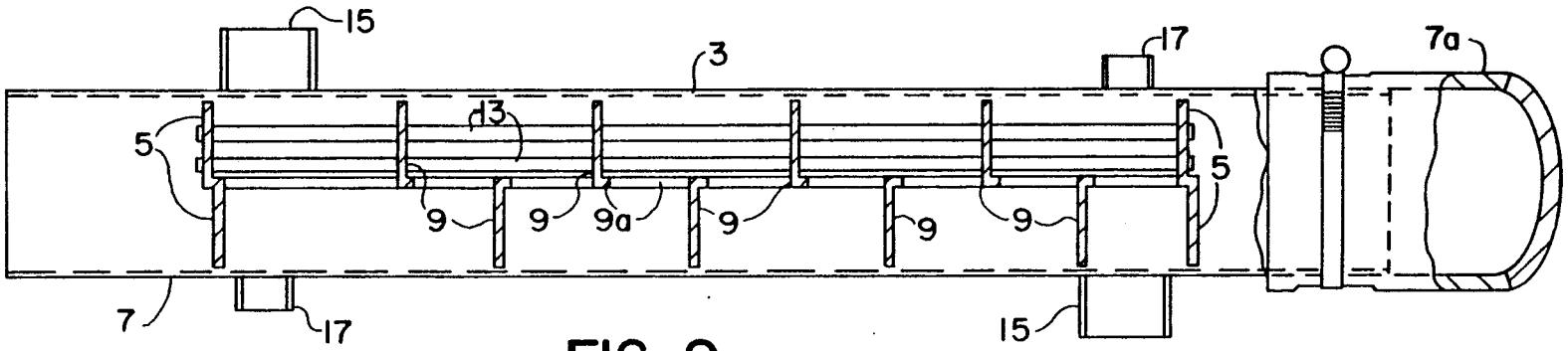
FIG. 9 shows a cross-sectional view of a method for forming the heat exchanger of this invention wherein the end caps (tube sheets) themselves may be integrally formed in combination with the baffles, and the sheet formed shell.

As can also be seen in FIG. 9, the heat exchanger of this invention may likewise be formed, integrally, to include its end caps for sealing the center of the tube bundle, particularly when manufactured for smaller designed applications, such as when used in conjunction with cooling systems for trucks, vehicles, or the like. As can be seen, the heat exchanger having its baffles 9 are integrally formed from the central wall 9*a* as formed from the sheet material, which is likewise shaped around the formed baffles to create the integral shell 3. But, at the ends of the heat exchanger, a pair of baffles may be shaped, and bent, as shown at 5, to integrally form the end caps for the heat exchanger, and which when welded into position within the shell 3, seals off the internal configuration of the heat exchanger, from any fluid that may be flowing through the bonnets 7, or the attached hose 7*a*. Then, the nozzles or inlets 15, and the connectors or outlets 17, may be attached to the formed outer shell 3, to allow for the fluid to be heated to pass through the heat exchanger, in the usual fashion. The end baffles 5 forming the end caps, may be stamped and folded from their extensions as stamped in opposite directions from the central wall 9*a* of the sheet.

Figure 10:
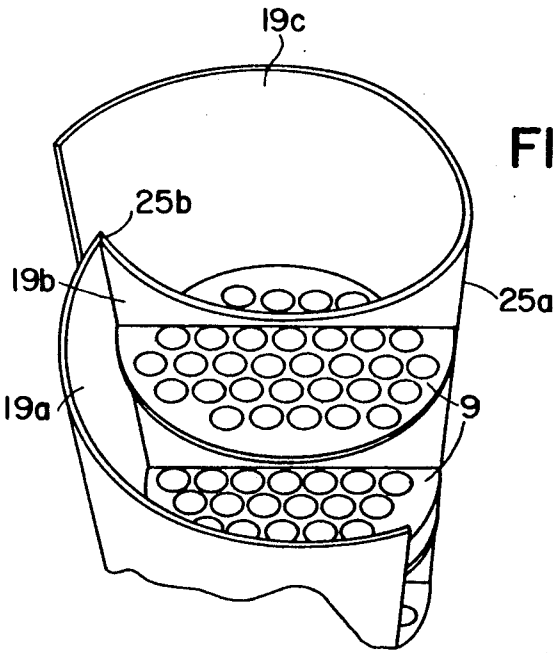
FIG. 10 provides another view, similar to that as disclosed in FIG. 4, showing how the sheet materials may be wrapped about the integrally formed baffles to form the heat exchanger of this invention.

FIG. 10 is similar to that as previously described with respect to FIG. 4, and shows the configuration of the central panel or wall 9*b*, having the various baffles 9 stamped and folded therefrom, and which are useful for holding and supporting the various tubes of the heat exchanger. Once this is formed, through stamping, or cutting as previously explained, then the remaining integral portions of the sheet 19 may be folded around their formed baffles, as shown as 19*a* and 19*c*, into the configuration of an integral heat exchanger. As seen, the shell, at its ends, extends beyond the baffles for forming shell extensions at each end, to facilitate its connection when installed into usage.

Figure 11:
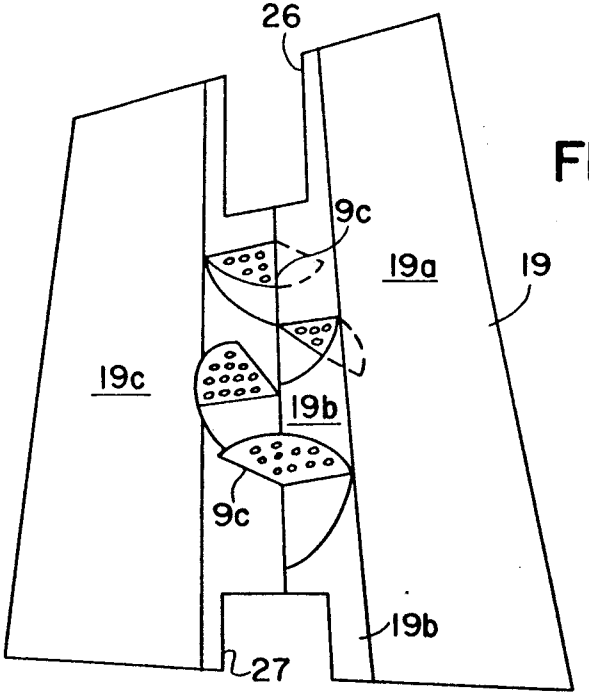
FIG. 11 discloses how the integral sheet may be used for forming integral tube supports of a quarter circular design, with the remaining portions of the sheet being cut out, in preparation for wraparound of the sheet to form the outer shell for the formed heat exchanger.

FIG. 11 discloses how other forms of configured baffles, such as shown at 9*c*, may be formed along the central wall 19*b* of the sheet material 19, with its lateral segments 19*a* and 19*c* then capable of being folded arcuately about the configured baffles, to form the heat exchanger construction. The cut-out sections 26 and 27 are provided when condensable gases or similar fluids are on the shell side and tube support "only" is required. Bent baffles are formed at intervals as required for the tube support.

Figure 12:
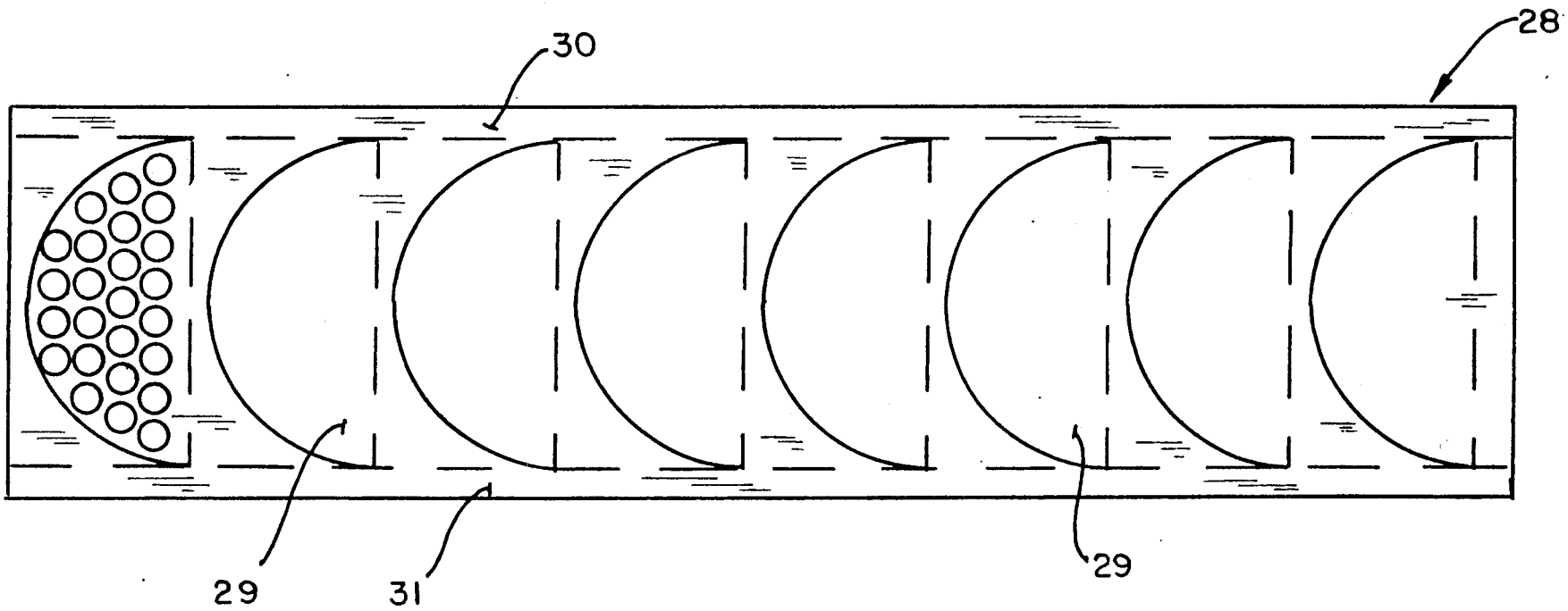
FIG. 12 is a plan view of a piece of metal sheet having a pair of integral side rails provided longitudinally along its sides, and which may be bent into configuration for securement within the conventional heat exchanger tube.

In addition, FIG. 12 discloses a plan view of an integral tube support, which may be formed from a singular piece of material, such as metal, with the configured baffles stamped therefrom, and which when bent in either direction, into perpendicularity, provide means for holding of a series of heat exchanger tubes in position within the heat exchanger. As is known, these baffles are used for tube support, and provide the skeletal framework for inserting tubes within a heat exchanger cylinder, and for holding a series of tubes into position, to achieve the heat exchange transfer and activity. In addition, the sheet 28 has the series of semi-circular like tube holding means, or baffles, 29 provided along its length, and which may be stamped therefrom, or perhaps even laser cut, and which when folded, ultimately, in opposite directions, essentially into Perpendicularity, provide means for holding the series of tubes into position, such as those as shown in FIG. 2, within a heat exchanger cylinder, while furnishing the baffling action for the medium being heated. As can be further noted, there are a series of side rails 30 and 31 provided longitudinally along the sides of the formed sheet, and which when bent into an angular relationship, generally in perpendicularity with the disposed sheet, and usually in opposite or same directions, provide the means for welding or supporting of this tube support into position within a heat exchange shell or cylinder, as when welded or otherwise secured therein, to provide a heat exchanger of the conventional type tube bundle arrangement, either of the U-tube type, or of a floating head design, with integral baffling. In any event, the sheet, with its tube supports, and the side rails integrally provided, all may be formed from a single sheet of metal, during its fabrication.

The foregoing provides an effort on the part of the inventor to furnish a simplified fabrication technique of making a skeletal or frame work for a tube bundle for use within a heat exchanger. Heretofore, usually tie rods were utilized for holding a tube sheet vertically within position, within a heat exchanger, and then locating the tube spaces therein, and securing the same with a locking nut, into position. This current invention, as described, can be located within the heat exchanger cylinder, and support a variety of tubes therein, and be of the floating head design or U-tube design, or be secured into position, as previously described. This monolithic or integral design form for the heat exchanger's shell, for holding the tube supporting assembly of this invention, eliminates the need for overlapping of any baffles of the type that have previously been used within heat exchangers, and thereby provides for structural advantages to an integral heat exchange of this particular design. Thus, the side rails, with their extensions, provide the means for holding the perpendicularly bent tube supports in position, within the heat exchange cylinder, during its assembly, and when applied in usage.

Furthermore, the precise punching of not only the tube supports, 29, within the formed structure can be conveniently done from a single die press operation, but likewise, the various apertures for holding the tubes in position, within the various baffles, can be conveniently prealigned during the punch press operation, during its fabrication. As previously stated, the side rails normally will be bent in opposite or same directions, generally at a tangent to the proximate edges of the tube holders 29, to provide proper placement for the integral tube bundle support within the heat exchange cylinder, during its assembly, and application.

In view of the above, it will be seen that the various objects and features of this invention are achieved and other advantageous results obtained. As various changes could be made in the above constructions without departing from the scope of the invention, it is intended that all matter contained in the above description or shown in the accompanying drawing shall be interpreted as illustrative and not in a limiting sense. For example, the concept of this invention could be used to integrally form a muffler.

Having thus described the invention, what is claimed and desired to be secured by Letters Patent is:

1. For use in a heat exchanger formed having an outer shell, a plate means integrally formed having a series of aligned tube supporting means therein, provided for supporting a series of tubes within the heat exchanger, said tube supporting means being bent into perpendicularity with respect to the plate means from which they are formed, said tube supporting means also forming baffling for the heat exchanger, and side rails provided along the longitudinal sides of the said plate means, which when bent into perpendicularity, provides means for supporting a series of heat exchange tubes within the heat exchanger, said side rails, tube supporting means, and plate means, all being integrally formed as a single component from a single sheet of metallic material.

2. The heat exchanger of claim 1 wherein tube supporting means includes a series of formed baffles, said baffles having a plurality of openings formed therein in which the tubes are received.

3. The heat exchanger of claim 2 and wherein there being a slight space between the periphery of the formed baffles and the interior surface of the heat exchanger shell during locating of the integral tube supporting means and baffles and side rails, formed from the singular plate means, within said heat exchanger shell.

* * * * *